US006315294B1

(12) United States Patent
Belleville

(10) Patent No.: US 6,315,294 B1
(45) Date of Patent: Nov. 13, 2001

(54) HEAT TARGET

(75) Inventor: Denis Belleville, Fussy (FR)

(73) Assignee: Etat Francais represente par le Delegue General pour l'Armement, Armees (FR)

( * ) Notice: Subject to any disclaimer, the term of this patent is extended or adjusted under 35 U.S.C. 154(b) by 0 days.

(21) Appl. No.: 09/521,600

(22) Filed: Mar. 9, 2000

(51) Int. Cl.[7] ..... F41J 1/08
(52) U.S. Cl. ..... 273/348.1; 273/407
(58) Field of Search ..... 273/348.1, 359, 273/369, 407, 406; 250/494.1, 495.1; 345/110; 40/466, 473, 475, 503, 453, 408

(56) References Cited

U.S. PATENT DOCUMENTS

| | | | | |
|---|---|---|---|---|
| 4,240,212 | * | 12/1980 | Marshall et al. | 273/348.1 |
| 4,260,160 | * | 4/1981 | Ejnell et al. | 273/408 |
| 4,279,599 | * | 7/1981 | Marshall et al. | 273/348.1 |
| 4,346,901 | * | 8/1982 | Booth | 273/408 |
| 4,405,132 | * | 9/1983 | Thalmann | 273/348.1 |
| 4,524,386 | | 6/1985 | Scott et al. . | |
| 4,799,688 | * | 1/1989 | Kellman et al. | 273/348.1 |
| 4,946,171 | | 8/1990 | Merle et al. . | |
| 5,065,032 | * | 11/1991 | Prosser | 273/348.1 |
| 5,066,019 | * | 11/1991 | Dean et al. | 273/348.1 |
| 5,126,577 | * | 6/1992 | Trent | 273/348.1 |
| 5,528,258 | * | 6/1996 | Moon | 345/110 |
| 5,734,495 | * | 3/1998 | Friedman | 40/453 |

FOREIGN PATENT DOCUMENTS

| | | | | |
|---|---|---|---|---|
| A-0156070 | | 10/1985 | (EP) . | |
| 1779900 | * | 12/1992 | (RU) | 273/407 |

* cited by examiner

*Primary Examiner*—Mark S. Graham
(74) *Attorney, Agent, or Firm*—Oliff & Berridge, PLC

(57) ABSTRACT

A heat target for producing, in particular, a thermal image composed of several bands and having at least one layer of electrically conducting material connected to two electrodes that are connected to means able to generate a potential difference between them, the target further comprising at least one module resting on a support and forming all or part of a band the at least one module having at least two longitudinal faces and a supporting structure on all or part of which rests a layer made of the electrically conducting material connected to two electrodes connected to means able to generate a potential difference between them.

15 Claims, 3 Drawing Sheets

HEAT TARGET

BACKGROUND OF THE INVENTION

The present invention relates to the field of targets, and in particular, a heat target for creating a thermal image composed of several bands and having at least one layer of electrically conducting material connected to two electrodes connected to means able to generate a potential difference between them, said layer being attached to a support.

Optronic devices for daytime and nighttime vision associated with weapons or weapon systems for land, sea, and air forces require a checking means for their validation. Targets enable the performance of these optronic devices to be quantified relative to contrasts in the visible or thermal infrared ranges, and relative to the detection, recognition, and identification ranges of systems at actual distances.

The STANAG 4347 and STANAG 4349 documents define procedures for optronic device testing. The former relates to the definition of normal static range performances of thermal imaging systems and the latter, to measuring the minimum resolvable temperature difference of thermal imaging systems.

The minimum resolvable temperature difference of thermal imaging systems is a function that, at an angular frequency, recognizes the smallest temperature detection $\Delta\theta$ such that the target bars are placed:

normal to the axis of the observation system in the center of the field at a distance such that the successive bars, corresponding to a certain frequency, can be discerned by the optronic device tested.

The thermal imaging system links the thermal resolution and angular resolution of all the elements involved in the signal path within the system. Thus it depends on:

the objective the detector the electronics the display system the observer (normal visual acuity, good ability to evaluate colors, and good experience in this type of measurement)

the atmospheric transmission.

The function of the optronic is to supply visual information to the observer. The information has to be qualified and quantified.

For this purpose, the following three types of tests are generally performed: Detection, Recognition, and Identification.

Detection is the act of detecting a hot spot in a scene.

Recognition is finding out the type of object in a scene (tank, light vehicle, infantryman, etc.).

Identification is the precise determination of object (AMX30, T72, etc.).

For an object to be detected, recognized, or identified with some probability of success, the system must resolve a number of points on the object when placed at a far distance, and this number is a function of the type of test considered (Detection, Recognition, or Identification).

In fact, instead of points, spatial frequencies expressed in pairs of lines (or bars or bands) are considered.

There are empirical criteria that gives the probability of success probability value. The most widely used are the Johnson criteria.

The targets used for the visible mode correspond to the same spatial frequency as those of the thermal infrared mode.

Each type of test (Detection, Recognition, or Identification) and each mode (visible or thermal infrared) requires a specific target calculated by criteria relating to resolving power as a function of a 50% success probability.

In the thermal infrared mode, the targets used are the following:

Nighttime Detection:
uniform objective
bar width: 2.30 m

Nighttime Recognition:
3.5 line pairs per objective
bar width: 0.32 m

Nighttime Identification:
7 line pairs per objective
bar width: 0.16 m

In the visible mode, the targets used are the following:

Daytime Detection:
uniform objective
bar width: 2.30 m

Daytime Recognition:
3.5 line pairs per objective
bar width: 0.32 m

Daytime Identification:
7 line pairs per objective
bar width: 0.16 m

Since the pitch of the detector matrix may be different in the two directions (horizontal and vertical) the number of targets must be doubled to obtain both positions.

These types of targets are presented in FIGS. 1*a* to 1*f*.

In the visible mode, bands 5 are in one color shade and bands are in another shade of the same color, for example two shades of grey with a contrast of for example, 20%, contrast between black and white being considered at 100%.

In the infrared mode, the bands correspond to infrared radiation transmitting surfaces. Bands 5 correspond to a surface at a first temperature T1, and bands 6 correspond to a surface with a second temperature T2.

Targets 1*a* to If are used respectively for:

vertical detection, horizontal detection, vertical recognition, horizontal recognition, vertical identification, horizontal identification.

Thus, detection, recognition, and identification measures in the two modes, visible and thermal infrared, require 12 targets.

This multiplicity of targets has a number of disadvantages. Substantial logistics are required, and the time taken to change over the test type (detection, recognition, or identification), the position, (horizontal or vertical), and the mode (visible or infrared), require the target to be replaced each time, and considerably increasing the total testing time to evaluate the performance of an optronic device at an actual distance.

The goal of the invention is to overcome these disadvantages by providing a target that is very simple to manufacture, equally simple to maintain, and limits the time lost when the type of test is changed.

SUMMARY OF THE INVENTION

The proposed solution is a heat target for creating in particular, a thermal image composed of several bands and having at least one layer of electrically conducting material connected to two electrodes connected to means able to generate a potential difference between them. The target being characterized as having at least one module resting on a support and forming all or part of a band, and having a supporting structure where all or part of which rests at least one layer of electrically conducting material connected to two electrodes connected to means able to generate a potential difference between them. The heat target comprising a shaft-plus-bearing assemblies, with the bearings being integral with the support and the shafts being integral with the module for allowing all or part of the module to rotate.

The heat target may also comprise a motor of the stepper type for example, with two directions of rotation, or an asynchronous motor at a safe voltage with an end-of-travel stop.

According to one particular characteristic, the heat target comprises at least two independent modules each forming all or part of a band and each having at least two longitudinal faces and a supporting structure on all or part of which rests at least one layer of electrically conducting material connected to two electrodes connected to means able to generate a potential difference between them, and having means allowing all or part of each module to rotate.

According to an additional characteristic, the at least two longitudinal faces of each of the modules are painted, the color of the paint or the shade of the first longitudinal face being different from that of the second longitudinal face.

According to an additional characteristic, the heat target has at least part of the support common to all the modules and the modules can be disposed in the same plane and all said first longitudinal faces of each of the modules can be positioned in the same plane with the aid of means for allowing rotation of all or part of the module.

In addition, the heat target may comprise means for allowing the modules to rotate about itself, particularly in the plane that it defines, and means for rotating heat target in the plane that it defines.

According to an additional characteristic, at least one of the modules has a first and a second face covered by a layer of electrically conducting material connected to two electrodes connected to means that can generate a potential difference between them, said layer being attached to the supporting structure.

According to another characteristic, at least one of the modules has a second longitudinal face made of a material not connected to electrodes, the material being electrically conducting or electrically nonconducting.

According to one particular characteristic, the electrically conducting layer or layers is/are composed of a fiberglass-carbon fabric.

According to one particular characteristic contributing to simulation accuracy, the electrodes are made of metal straps. Moreover, the conducting layer is held on the strap by one or more clamps, the total length of whose jaws is preferably greater than or equal to the strap length.

BRIEF DESCRIPTION OF THE DRAWINGS

Other advantages and characteristics will emerge from the description of a particular embodiment of the invention with reference to the attached figures, of which.

DETAILED DESCRIPTION OF THE INVENTION

Figure 1A:
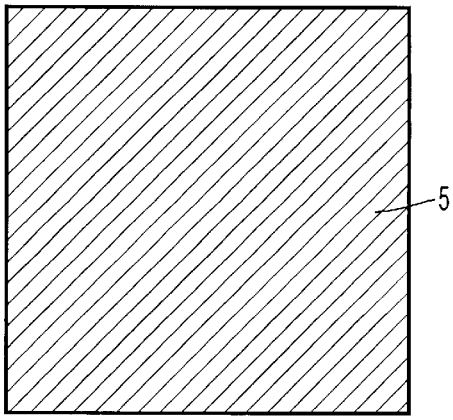
FIG. 1a PRIOR ART
FIGS. 1*a* to 1*f* are diagrams of targets according to the prior art and used for detection, recognition, and identification testing.
Figure 1B:
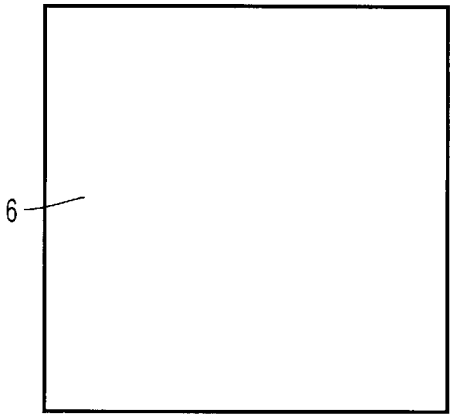
FIG. 1b PRIOR ART
Figure 1C:
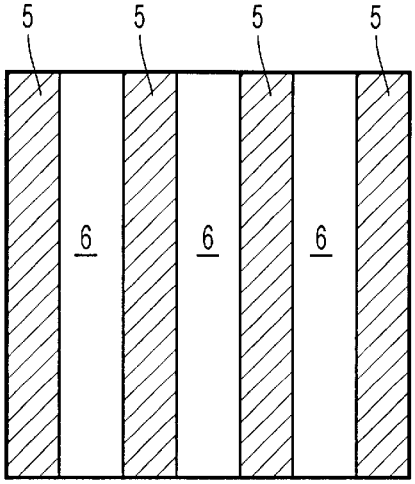
FIG. 1c PRIOR ART
Figure 1D:
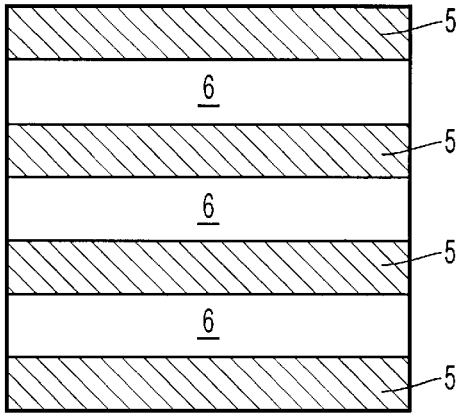
FIG. 1d PRIOR ART
Figure 1E:
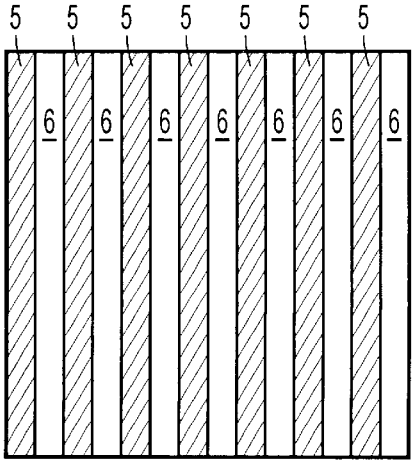
FIG. 1e PRIOR ART
Figure 1F:
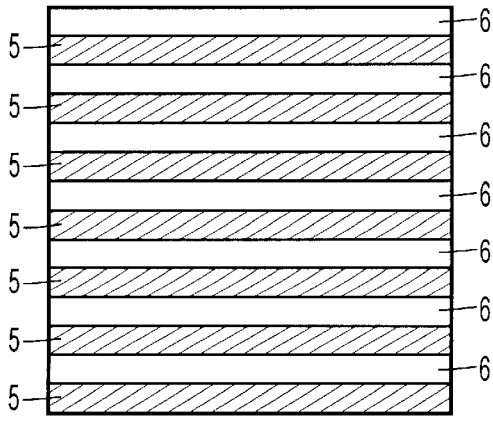
FIG. 1f PRIOR ART
Figure 2:
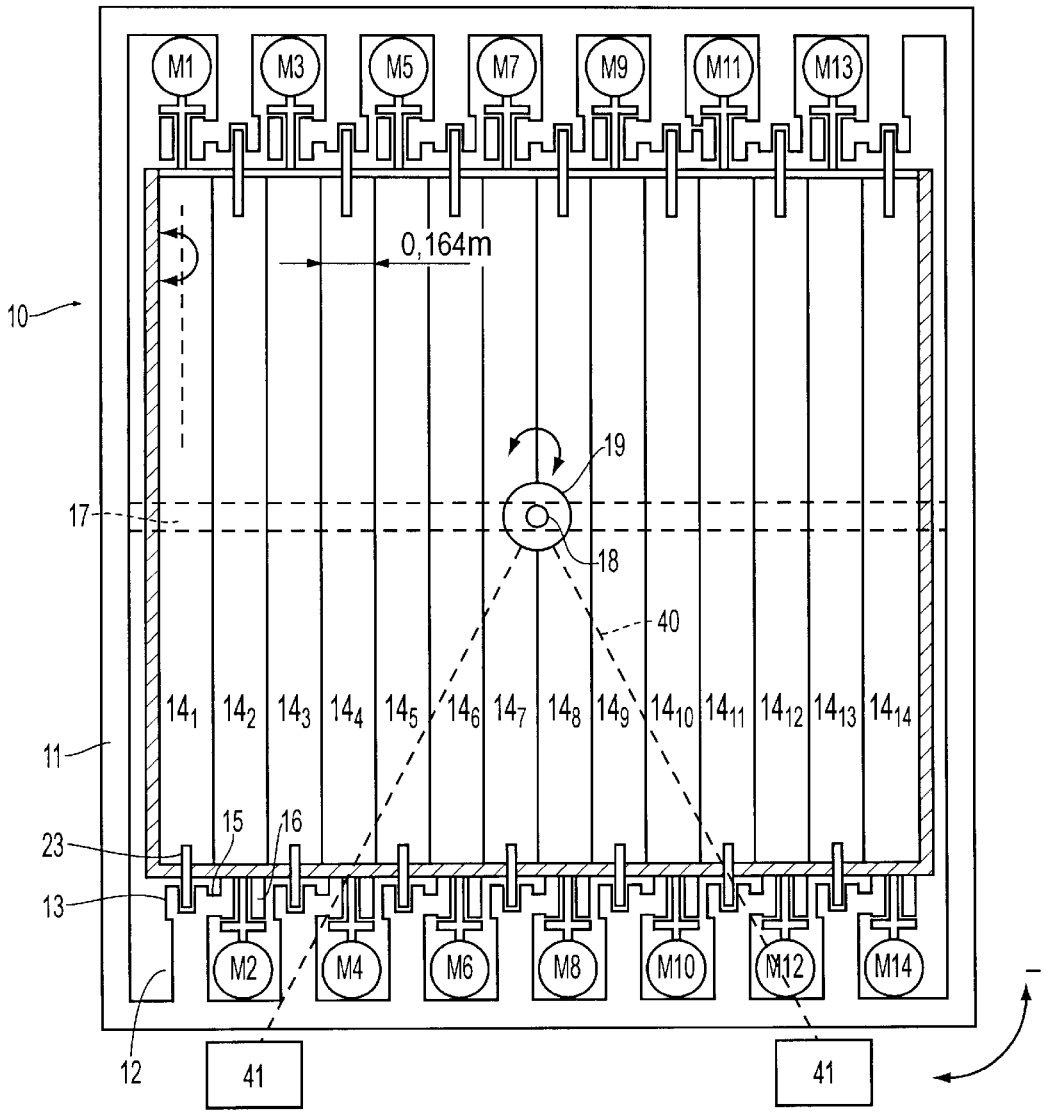
FIG. 2 shows one embodiment of a target according to the invention.

FIG. 2 shows a target 10 according to a first particular embodiment of the invention.

The target 10 includes a support having a frame 11 and supporting elements 12, 13, 15, 16 to which independent, juxtaposed modules $\mathbf{14}^1$ to $\mathbf{14}_{14}$ are attached. The end of each one of supporting elements 12 is comprised of a bearing 13 designed to receive a shaft 23 of a first module. It also has a bore in which one of the ends of a cylindrical spacer 15, threaded at both its ends, is attached, and another bearing 16 intended for a second module next to the first module is attached to the other end of spacer 15.

Figure 3:
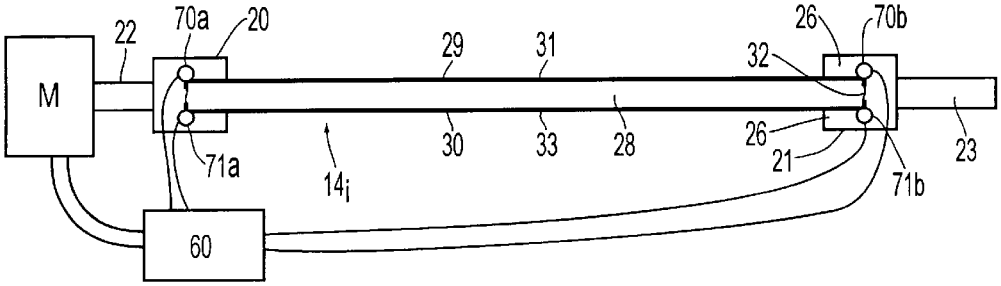
FIG. 3 shows a cross section through a module according to the invention.

As shown in FIG. 3, each module $14_{i(i=1,\ldots 14)}$ has two U-shaped sections 20 and 21 made of insulating material, to each of which is attached a shaft, 22 and 23 respectively, shaft 22 being connected to a stepper motor M supplied by means 60 able to generate a potential difference of 48 V.

These U shapes 20 and 21 are 0.16 m high, approximately 0.05 m wide, and 0.05 m deep; the distance between the two arms 26 of the U as well as their length is approximately 0.03 m.

Each module $\mathbf{14}_i$ also has a board 28 made of wood or a heat-insulating material (wood-polyurethane-wood sandwich or other) 0.16 m high, approximately 2.36 m wide, and 0.03 m deep, which can be attached to the U shapes by force fitting or some other means.

To each of longitudinal faces 29, 30 of board 28 (these longitudinal faces being those defined by the dimensions of 2.36 m×0.16) there is attached a layer, 31 and 33 respectively, of electrically conducting material connected to two electrodes, 70*a;* 70*b* and 71*a;* 71*b,* respectively, having plate-shaped ends and themselves connected to means 60 able to generate a potential difference between them.

These layers 31 and 33 made of an electrically conducting material can for example be made of a fiberglass/carbon fabric, for example, HEXEL 43596 16/34 made by Hexel or CG202 made by Seal.

To simplify production of this module, the width of electrically conducting layers 31 and 33 is slightly greater than that of board 28, 2.38 m for example, so that their ends fold over lateral surfaces 32 of board 28 without touching each other and so that the board and layers 31 and 33 and the plate-shaped ends of the electrodes are force-fitted into U-shaped sections 20 and 21.

Frame 11 is attached to a supporting element 17 shown in dashed lines and integral both with a shaft 18 connected to a motor 19 whose axis of symmetry is the same as that of support 12, and with two other supporting elements 40 each ending in a foot 41 that can serve as a support for a lift truck.

At least one thermocouple, not shown, is disposed on each of electrically conducting layers 31 of each module. Each of these thermocouples is connected to a control unit, the Jumo brand for example, itself connected to voltage generator 60, preferably portable, this generator being connected to said electrodes 70*a;* 70*b;* 71*a;* 71*b.* Thus, the temperature is at a set value T1 over the entire first conducting layer 31 and at a set value T2 over the entire second conducting layer 33.

Moreover, electrically conducting layers 31 and 33 are provided with different-colored coats of paint, in this case two shades of green, the colors contrasting with each other.

The operation of the target according to this embodiment is as follows: in the thermal infrared mode a potential difference is generated between electrodes 70*a* and 70*b* to obtain a temperature T1 on longitudinal face 29 and between electrodes 71*a* and 71*b* to obtain a temperature T2 on longitudinal face 30, while in the visible mode no potential difference is generated between the various electrodes.

For operation of the target for vertical detection, hence at ambient temperature, all the longitudinal faces 30 of the modules are positioned with the aid of motors M1 to M14 of the respective modules $\mathbf{14}_1$ to $\mathbf{14}_{14}$, on the front face of the target, this face being defined as the face visible to the optronic device to be tested.

For operation of the target for horizontal detection, namely at a given temperature, all the longitudinal faces 29 of modules $\mathbf{14}_1$ to $\mathbf{14}_{14}$, namely those covered by a layer 31 of electrically conducting material, are positioned with the aid of motors M1 to M14 of modules $\mathbf{14}_1$ to $\mathbf{14}_{14}$ respectively, on the front face of the target.

For operation of the target for vertical recognition, the modules are associated in successive pairs, two modules of the same pair presenting the same face 29 or 30 to the objective, while the two modules of the next pair present, as a pair, the same face 29 or 30, these faces being different from those presented by the preceding pair of modules.

Thus, modules $\mathbf{14}_1$, $\mathbf{14}_2$, $\mathbf{14}_5$, $\mathbf{14}_6$, $\mathbf{14}_9$, $\mathbf{14}_{10}$, $\mathbf{14}_{13}$, and $\mathbf{14}_{14}$ for example have their longitudinal faces 29 covered by a layer 31 of electrically conducting material while modules $\mathbf{14}_3$, $\mathbf{14}_4$, $\mathbf{14}_7$, $\mathbf{14}_8$, $\mathbf{14}_{11}$, and $\mathbf{14}_{12}$ present their wooden faces 30.

For vertical identification operation of the target, the even-numbered modules $\mathbf{14}_2$, $\mathbf{14}_4$, $\mathbf{14}_6$. . . each present the same longitudinal face while the odd-numbered modules $\mathbf{14}_1$, $\mathbf{14}_3$, $\mathbf{14}_5$. . . also present the same face as each other, this face being different from the one presented by the even-numbered modules.

For horizontal recognition or horizontal identification operation, one need only operate motor 19 which causes the target to rotate in its plane by an angle of $\pi/2$ radians.

Figure 4:
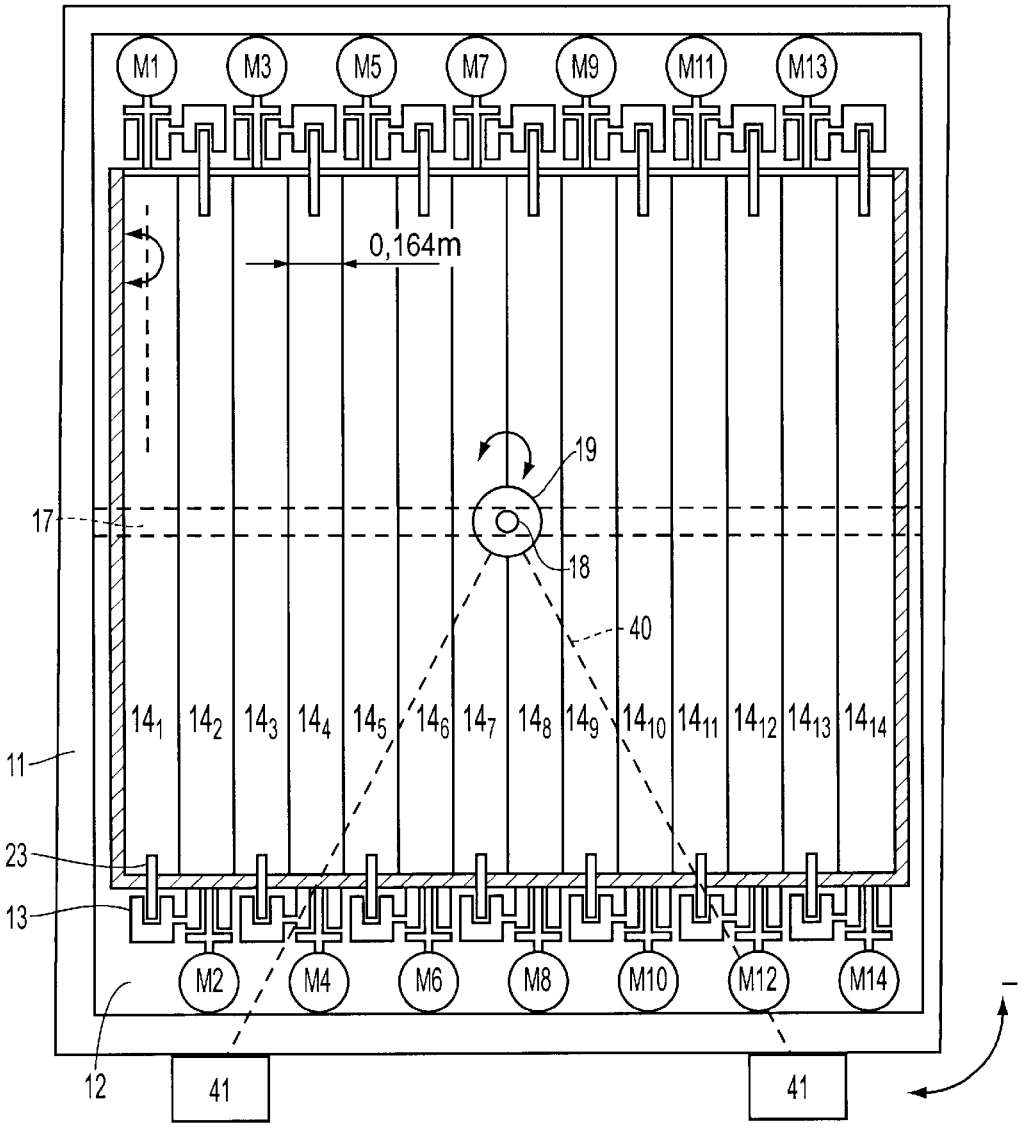
FIG. 4 shows a second embodiment of a target according to the invention.

FIG. 4 shows a target 10 according to a second particular embodiment of the invention.

This target 10*a* has a support having a frame 11 and means enabling each module to move rotationally but not translationally.

These means are in particular bearings 13 attached to frame 11.

Figure 5:
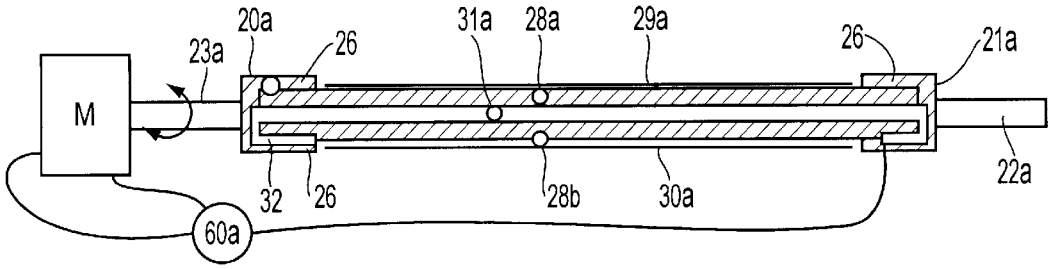
FIG. 5 shows a cross section through a module according to this second embodiment.

As shown in FIG. 5, each module $\mathbf{14}_1$ has two U-shaped sections 20*a* and 21*a* made of a conducting material, to each of which is attached a shaft, 22*a* and 23*a* respectively, shaft 23*a* being connected to an asynchronous motor M supplied by means 60*a* able to generate a potential difference of 48 V.

These sections 20*a* and 21*a* are 0.16 m high, approximately 0.05 m wide, and 0.05 m deep, and the distance between the two arms 26 of the U as well as their length is approximately 0.03 m.

Each module $\mathbf{14}_1$ also has a two plywood boards 28*a,* 0.16 m high, approximately 2.36 m wide, and 0.03 m deep. These two boards are separated by a layer 31*a* of electrically conducting material connected to two electrodes, in this case, the U-shaped sections 20*a* and 21*a,* themselves connected to means 60*a*.

The sandwich structure composed of two boards separated by layer 31*a* of electrically conducting material can be attached to the sections by force fitting or by a bolt, screw, etc. method of attachment.

This layer 31*a,* which for example can be made of a fiberglass/carbon fabric 0.16 m high and over 2.36 m wide, 2.4 m for example, so that its ends can be folded over the side surfaces of one and/or the other of boards 28*a* and 28*b,* and thus be in contact with the U-shaped sections constituting the electrodes.

As in the first embodiment described above, frame 11 is attached to a supporting element 17 shown in dashed lines and integral with a shaft 18 connected to a motor 19 whose axis of symmetry is the same as that of support 12, and two other supporting elements 40 each ending in a foot 41 which can serve as a support for a fork truck.

In order for testing to be done both in visible mode and in infrared mode with the same module, the longitudinal face 29*a* of board 28*a* is painted a first shade of grey while the longitudinal face 30*a* of board 28*b* is painted another shade of grey, the contrast between these two shades being 20%.

To control temperature T1 and T2 of the modules when they operate in thermal infrared mode, one thermocouple is positioned on module $\mathbf{14}_1$, and another thermocouple on module $\mathbf{14}_9$. All the modules to be set to temperature T1 are regulated like module $\mathbf{14}_1$ while all the modules to be set to temperature T2 are regulated like module $\mathbf{14}_9$.

Each of these thermocouples is connected to a control unit, the Jumo brand for example, itself connected to voltage generator 60*a,* preferably portable, this generator being connected to said electrodes 20*a* and 21*a,* which in this embodiment are comprised of the U-shaped sections. Thus, the temperature is at a set value T1 for module $\mathbf{14}_1$ and for all the modules that are intended to be at temperature T1, and at a set value T2 for module $\mathbf{14}_9$ as well as for all the modules intended to be at temperature T2.

Operation of the target in visible mode according to this embodiment is the same as that of the first embodiment described above.

Operation in thermal infrared mode of the target according to this embodiment is as follows:

For vertical detection operation of the target, hence at temperature T1, all the faces with the darkest paint, in this case faces 29*a,* namely those with the best emission coefficient, are preferably positioned with the aid of motors M1 to M14 of respective modules $\mathbf{14}_1$ to $\mathbf{14}_{14}$, on the front face of the target, this face being defined as that visible to the optronic device to be tested, and the temperature of all the faces 29*a* is voltage-regulated to temperature T1.

For horizontal detection operation of the target, namely at a temperature T2, the same positions of the modules as described in the context of vertical detection may be used, but temperature is set to temperature T2 rather than T1.

For vertical recognition operation of the target, the same positions of the modules as described in the context of vertical detection may be used, but these modules are combined in successive module pairs, both modules in a given pair being set to one of temperatures T1 or T2 and both modules of the next pair being set to the other of temperatures T1 or T2.

Thus, the longitudinal faces 29*a* of modules $\mathbf{14}_1$, $\mathbf{14}_2$, $\mathbf{14}_5$, $\mathbf{14}_6$, $\mathbf{14}_9$, $\mathbf{14}_{10}$, $\mathbf{14}_{13}$, and $\mathbf{14}_{14}$ are set to temperature T1 while the longitudinal faces 29*a* of modules $\mathbf{14}_3$, $\mathbf{14}_4$, $\mathbf{14}_7$, $\mathbf{14}_8$, $\mathbf{14}_{11}$, and $\mathbf{14}_{12}$ are set to temperature T2.

For vertical identification operation of the target, the same positioning of the modules as described in the context of vertical detection can be used but the longitudinal faces 29*a* of the evennumbered modules $\mathbf{14}_2$, $\mathbf{14}_4$, $\mathbf{14}_6$ . . . are set to temperature T2 while the longitudinal faces 29*a* of odd-numbered modules $\mathbf{14}_1$, $\mathbf{14}_3$, $\mathbf{14}_5$ . . . are set to temperature T1.

For horizontal recognition or horizontal identification operation, one need only command motor 19 to rotate the target in its plane by an angle of $\pi/2$ radians.

It should be noted that numerous modifications may be made to the target without departing from the framework of the invention. Thus, the bands can have any shape, or have the shape of a rectangle, a square, a circle, etc.

The electrodes can be made of metal straps held by clamps attached to a support.

The modules may have a fixed electrically conducting layer and have a mask with a surface area equal to half the longitudinal surface area of the module, said mask being able to pivot to conceal half the module.

The modules can thus have more than two longitudinal faces, for example three or four, thus forming a parallelepiped which in particular present four shades of the same color, or four different colors to the optronic device in visible mode. In the latter case, it should be noted that if the modules are to be juxtaposed they should preferably be positioned in two different planes so that they can rotate.

Finally, it will be noted that it is possible to heat the electrically conducting material of longitudinal face 29 without modifying the emission characteristics of face 30. The time taken to switch from detection operation to recognition or identification operation is limited to the time taken by the modules to rotate.

Moreover, the positions of the modules are controlled from a control module having a three-position switch (detection, recognition, identification) and a two-position switch (horizontal or vertical).

Moreover, the modules can be disposed inside a sealed envelope or be covered by a sealing film, at least in part.

What is claimed is:

1. A heat target for creating, on its front face, a thermal image, comprising:

a plurality of bands having at least one longitudinal electrically conductive material connected to two electrodes, the two electrodes connected to means able to generate a potential difference between them; and at least one module resting on a support and forming all or part of the band, the at least one module having at least two longitudinal faces and a supporting structure on all or part of which rests a layer made of the electrically conducting material connected to two electrodes connected to the means able to generate a potential difference between them, wherein the at least two longitudinal faces of each of the modules are painted, the first longitudinal face being painted different from that of the second longitudinal face; and said at least one module rotates so as to position one or another of the at least two longitudinal faces on a front face of the target.

2. The heat target according to claim 1, wherein the heat target comprises means able to cause all or part of the at least one module to rotate.

3. The heat target according to claim 2, wherein the means able to cause all or part of the at least one module to rotate is comprised of bearings integral with the support and shafts integral with the at least one module.

4. The heat target according to claim 2, wherein the means able to cause all or part of the at least one module to rotate comprises a motor.

5. The heat target according to claim 1, wherein the heat target comprises a part of a support that is common to a plurality of modules.

6. The heat target according to claim 2, wherein a plurality of modules are disposed in the same plane and all said first longitudinal faces of each module of the plurality of modules can be positioned in the same plane with the means able to rotate all or part of the module.

7. The heat target according to claim 1, wherein the heat target comprises means allowing the heat target to rotate about itself.

8. The heat target according to claim 7, wherein the heat target comprises means for rotating the target in the plane that the target defines.

9. The heat target according to claim 1, wherein the heat target comprises at least one module having a second layer of electrically conducting material connected to two electrodes connected to means able to generate a potential difference between them, and resting on the supporting structure, the first layer and the second layer of electrically conducting material not being connected with each other.

10. The heat target according to claim 4, wherein the motor is of a stepper type with two directions of rotation.

11. The heat target according to claim 4, wherein the motor is an asynchronous motor at a safe voltage with an end of travel stop.

12. The heat target according to claim 1, wherein the electrically conducting material is composed of a fiberglass-carbon fabric.

13. The heat target according to claim 1, wherein the electrodes are made of metal straps.

14. The heat target according to claim 13, wherein the conducting layer is held on an associated metal strap by at least one clamp, with a jaw, the jaw preferably greater than or equal to a length of the metal strap.

15. A heat target for creating, on its face, a thermal image, comprising:

a plurality of modules resting on a support and forming all or part of a band, each module of the plurality of modules having a first longitudinal of electrically conducting material and a second longitudinal of electrically conducting material connected to two electrodes connected to means able to generate a potential difference between them, the first longitudinal and the second longitudinal not being connected with each other, wherein the first longitudinal and the second longitudinal are painted, the first longitudinal being painted different from the second longitudinal;

a first motor, with bearings integral with the support and shafts which are integral with the plurality of modules, able to rotate all or part on the plurality of modules so as to position one or another of the first longitudinal or the second longitudinal on a front face of the target, wherein the plurality of modules are disposed in the same plane that the target defines, and;

a second motor allowing the heat target to rotate about itself in the plane that the heat target defines.

* * * * *